United States Patent [19]

Webb, Jr.

[11] 4,004,288

[45] Jan. 18, 1977

[54] BATTERY OPERATED FIRE DETECTION UNIT

[75] Inventor: William Webb, Jr., Denver, Colo.

[73] Assignee: Unitec, Inc., Denver, Colo.

[22] Filed: Jan. 29, 1975

[21] Appl. No.: 545,251

[52] U.S. Cl. ..... 340/237 S; 340/248 B; 340/249

[51] Int. Cl.[2] ..... G08B 17/10

[58] Field of Search ..... 340/237 S, 249, 409, 340/248 B; 250/381, 382, 384, 385

[56] References Cited

UNITED STATES PATENTS

| | | | |
|---|---|---|---|
| 3,717,862 | 2/1973 | Sasaki | 340/237 S |
| 3,842,409 | 8/1974 | Mayer | 340/237 S X |
| 3,866,195 | 2/1975 | Ried, Jr. | 340/237 S |

*Primary Examiner*—John W. Caldwell
*Assistant Examiner*—Daniel Myer
*Attorney, Agent, or Firm*—O'Rourke & Harris

[57] ABSTRACT

A battery operated fire detection unit that is capable of independent monitoring through sensing of smoke with the unit maintaining monitoring capabilities over long periods of time. A smoke detector senses the presence of smoke indicative of a fire and, when above a predetermined threshold, produces an electrical output signal that is coupled through latch circuitry and a logic gate to an audible alarm, such as a horn. An oscillator is also provided, the output of which is coupled through a differentiator to a logic gate, which gate also receives the output from the latch circuitry connected with the smoke detector. In the absence of a sensed fire condition, a light is periodically energized at a rate dependent upon the oscillator frequency to indicate that the system is operable, and the light is constantly energized to indicate the sensed presence of fire. An automatic battery, or low voltage, monitoring circuit is also provided to actuate the audible alarm when the sensed voltage drops below a predetermined minimum to indicate the need for battery replacement.

11 Claims, 5 Drawing Figures

BATTERY OPERATED FIRE DETECTION UNIT

FIELD OF THE INVENTION

This invention relates to a fire detector unit and, more particularly, relates to a battery operated fire detection unit.

BACKGROUND OF THE INVENTION

As society has grown more complex, an increasing need has arisen for more and better protection devices that can, and will, warn of unwanted and/or hazardous conditions. One of the more potentially dangerous of these conditions can arise when a fire is ignited that is not readily detected. Obviously, such a fire can cause serious, and possibly fatal, injury to human and/or other animal life, as well as causing extensive property damage, particularly if not detected early and quickly brought under control. But such a fire might not be readily detected by observation, either by igniting in an area not then frequented by a human observer, or due to inability of observation, such as during periods of sleep.

Detection devices have been heretofore suggested and/or utilized for indicating the presence of conditions such as fire, and while these devices have heretofore been utilized with varying degrees of success, a need has still existed for a device capable of independent operation that provides reliable monitoring to sense the presence of fire even though such monitoring extends over long periods of time.

Among devices now known and utilized for fire detection are systems that utilize external voltage sources, such as, for example, systems described and claimed in U.S. Pat. application Ser. No. 314,689, filed Dec. 13, 1972 by Ronn H. Mayer and entitled "Ionization Detector Apparatus," and U.S. Pat. application Ser. No. 504,489, filed Sept. 9, 1974 by William Webb, Jr., and entitled "Combustion Detection Device," both of which applications are assigned to the assignee of the present invention.

SUMMARY OF THE INVENTION

This invention provides an independently operable fire detection unit that is battery powered and capable of operation over long periods of time. The unit provides an indication of the sensed presence of a fire, that the unit is operating satisfactorily, and an automatic indication of needed battery replacement.

It is therefore an object of this invention to provide an improved fire detection unit.

It is another object of this invention to provide an improved fire detection unit that is independently operable.

It is still another object of this invention to provide a battery operated detection unit.

It is yet another object of this invention to provide a battery operated fire detection unit that is compact and yet is operable over long periods of time.

It is another object of this invention to provide a battery operated fire detection unit that includes means for indicating that the system is operable.

It is yet another object of this invention to provide a fire detection unit that automatically indicates the presence of low voltages which could cause faulty operation.

It is still another object of this invention to provide a battery operated fire detection unit that automatically indicates a need for battery replacement.

With these and other objects in view which will become apparent to one skilled in the art as the description proceeds, this invention resides in the novel construction, combination, and arrangement of parts substantially as hereinafter described and more particularly defined by the appended claims, it being understood that such changes in the precise embodiment of the hereindisclosed invention are meant to be included within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
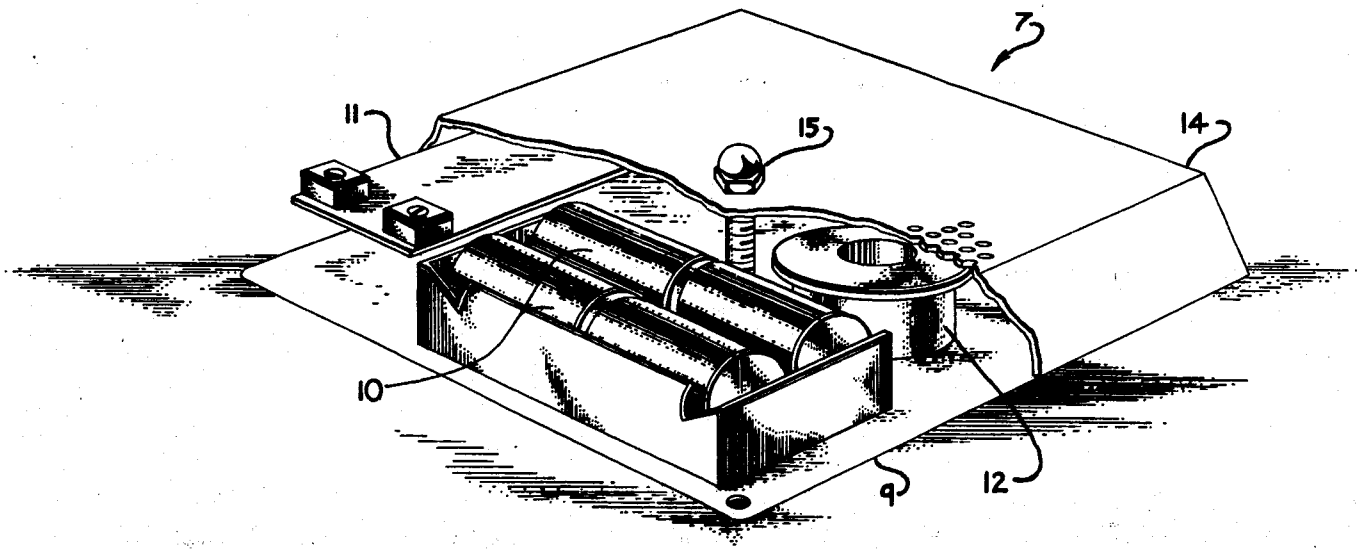
FIG. 1 is a partially cut-away perspective view of the battery operated fire detection unit of this invention.

Referring now to the drawings, the numeral 7 indicates generally the fire detection unit, or system, of this invention. As shown in FIG. 1, the unit is preferably compact and can be positioned for use in any convenient location.

As shown, the unit includes a mounting base 9 upon which a plurality of batteries 10 are removably mounted and retained in conventional manner. In addition, a printed circuit board 11 is also mounted upon base 9, as is a horn 12 to provide an alarm indication. The unit preferably has a cover 14 placed thereover that is removably mounted, as by means of nut 15. As indicated in FIG. 1, cover 14 is preferably at least partially a screen type of cover and may be attractively decorated as desired. Since, as indicated in FIG. 1, the unit is quite small and compact, it may be conveniently positioned as, for example, upon the wall of a home, and, when in operation, need only be periodically checked to insure proper operation. The unit offers automatic monitoring to sense for the presence of fire with monitoring capabilities extending over long periods of time without need for battery replacement.

Figure 2:
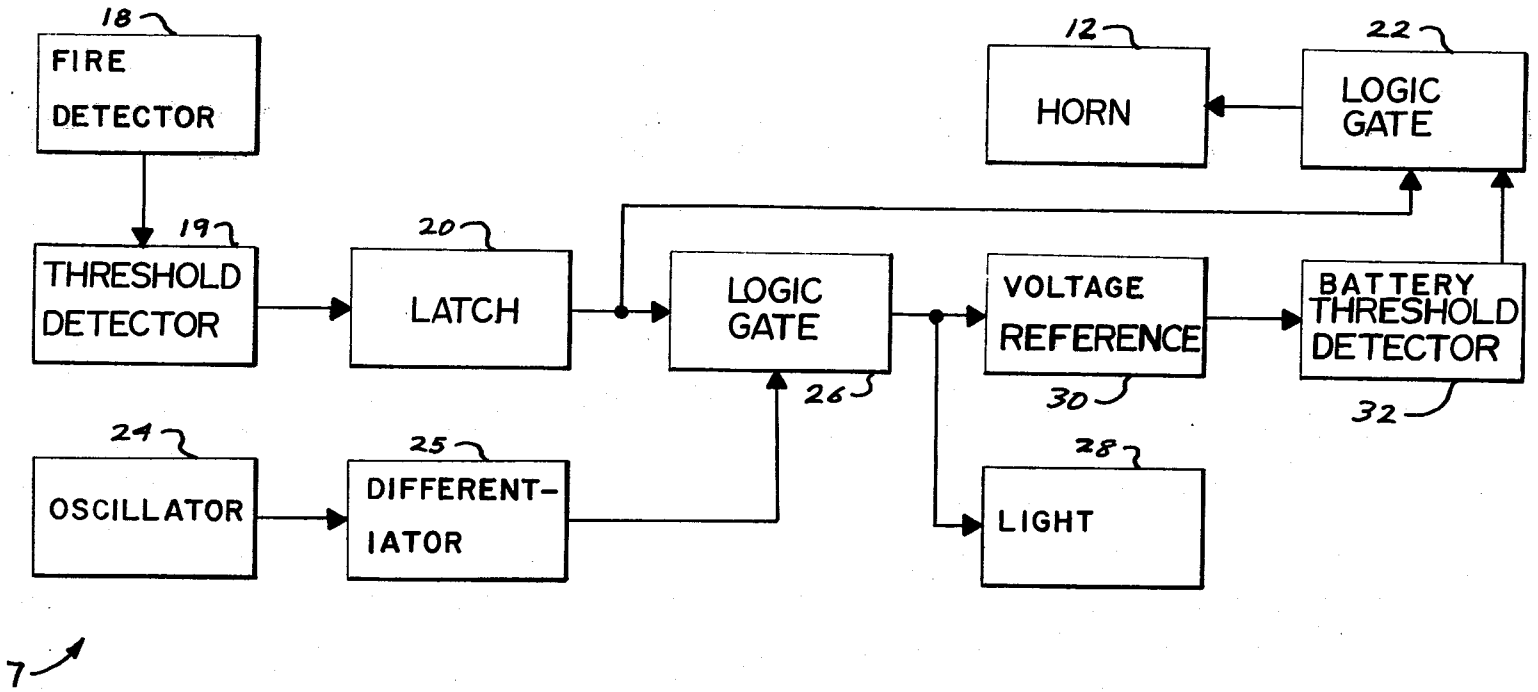
FIG. 2 is a block diagram of the fire detection unit shown in FIG. 1.

As shown in FIG. 2, fire detector 18, which provides an output signal when smoke is detected indicative of a fire, is connected with a threshold detector circuit 19, the output from which is coupled to latch circuitry 20. An output from threshold detector 19 is provided only when a predetermined value is exceeded, and when so provided, an output is provided through latch circuitry 20 through logic gate 22 to an audible alarm, shown as horn 12 in FIG. 2. Thus, when the threshold value is exceeded and an output is provided through latch circuitry 20 and gate 22, an alarm is sounded indicative of a sensed fire condition.

As also indicated in FIG. 2, unit 7 also includes an oscillator 24 which provides an output to differentiating circuit 25, which in turn provides an output to logic gate 26. Logic gate 26 also receives an output from latch circuitry 20 and the output of the logic gate is connected with a visual indicator, shown as light 28 in FIG. 2. The oscillator preferably has an oscillation frequency of 30 seconds with a positive pulse of 15 seconds during each oscillation. This causes light 28 to be energized, or blinked, once each 30 seconds to show that the system is operable. When a fire is sensed, however, to cause an output from threshold detector 19, the output coupled through latch circuitry 20 and logic gate 26 causes light 28 to remain constantly energized and thus also serves as an indication of a sensed fire condition.

As also shown in FIG. 2, the output from logic gate 26 is also coupled to a voltage reference circuit 30 the output of which is coupled to battery threshold detector 32. Battery threshold detector 32 monitors for low voltage indications from the batteries and when a low voltage is sensed, is coupled from detector 32 through logic gate 22 to sound horn 12 and indicate the low voltage and the need for battery replacement. Horn 12 creates a short audible sound once each 30 seconds to provide the low voltage indication and need for battery replacement.

Figure 3:
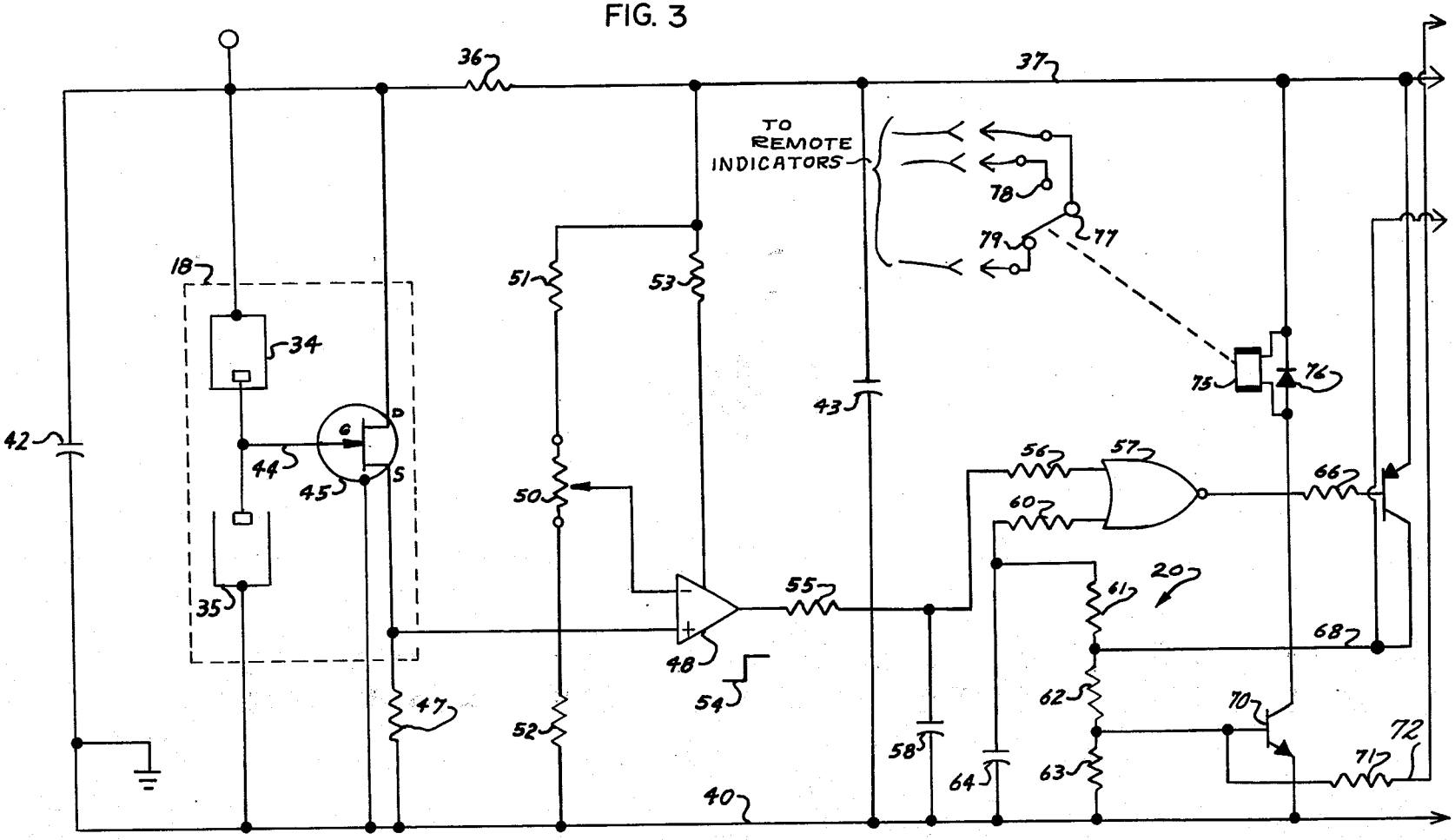
FIG. 3 is an electrical schematic diagram of the detecting and latching circuitry shown in the block diagram FIG. 2.

Referring now to FIG. 3, the detection and latching circuitry is shown in electrical schematic form. As shown, ionization detection means 18 includes a pair of smoke detection chambers 34 and 35. Detection chamber 34 is a closed chamber while detection chamber 35 is an open chamber so that chamber 34 is used as a reference chamber, and chamber 35 is used as an active chamber to sense the presence of smoke so that the unit is able to provide an output indicative of sensed smoke.

The chambers are ionization chambers and may include, for example, americium 241 or other radioactive materials, such as radium 226. The chambers 34 and 35 are connected at opposite sides between a voltage source and ground with chamber 34 being shown connected through resistor 36, lead 37, switch 38, and lead 39 to the positive side of batteries 10, which batteries preferably provide a +12 v.d.c. power supply. Chamber 35 is connected to ground lead 40, which lead is connected to lead 41 connected to the negative side of battery power source 10. Ionization detector 18 senses the products of combustion present in the atmosphere surrounding the detector and provides an output voltage indicative thereof. In addition, capacitors 42 and 43 to ground are connected at opposite sides of resistor 36, as also indicated in FIG. 3.

The output from the detector 18 is coupled through lead 44 to the gate electrode of field effect transistor (FET) 45 (a junction field effect transistor). As indicated in FIG. 3, the drain electrode of the FET 45 is connected to the positive voltage source, while the source electrode is returned to ground through resistor 47 and is connected to the + input of operational transconductance amplifier 48. In normal operation and in the absence of sensed smoke, +7 volts is coupled to amplifier 48 from FET 45. Operational transconductance amplifier 48 is one of a three-amplifier plus voltage reference array utilized in this detection unit, and such amplifier arrays are known in the art and identified, for example, as CA 3060AD units sold by Radio Corporation of America.

The negative input to amplifier 48 is coupled from the movable contactor of potentiometer 50, which potentiometer is connected as a part of voltage divider including resistors 51 and 52 connected between the +12 volt power supply and ground. As shown in FIG. 3, amplifier 48 also is connected to the +12 volt power supply through resistor 53, while the output from amplifier 48 (shown by waveform 54 when smoke is detected) is coupled through resistors 55 and 56 to logic gate 57 (shown in FIG. 3 as a NOR gate).

Potentiometer 50 is initially set to provide about a +8 volt output to amplifier 48, which amplifier thus operates as a threshold detector, or comparator, with no output being produced from amplifier 48 until such time as the input from FET 45 exceeds that of the reference voltage. When this occurs, a positive output (see waveform 54) is produced and coupled to gate 57 (gate 57 is included in latch circuitry 20). A capacitor 58 to ground is connected between the junction of resistors 55 and 56.

A second input to gate 57 includes series connected resistors 60, 61, 62 and 63, with a junction of resistors 60 and 61 having a bypass capacitor 64 to ground connected therewith. The output from gate 57 is coupled through resistor 66 to the base of transistor 67, which transistor is normally maintained in an off condition. Transistor 67 has its emitter connected to the +12 volt power supply, while the collector is connected to the junction of resistors 61 and 62 and provides an output on lead 68 to activate horn 12 when the presence of a fire is sensed at detector 18. The junction of resistors 62 and 63 is connected to the base of transistor 70, which base also is connected through resistor 71 and leads 72 and 73 to remote alarm circuitry (lead 74 from the +12 volt power supply lead also being connectable with remote alarm circuitry remote application of power).

The emitter of transistor 70 is connected to ground lead 40 while the collector is connected to relay coil 75 having diode 76 connected in parallel therewith. Relay 75 is optional and controls movable contactor 77 for movement between contacts 78 and 79. Contactor 77 and contacts 78 and 79 may be connected by leads with equipment to remotely indicate the presence of fire, if desired.

Figure 4:
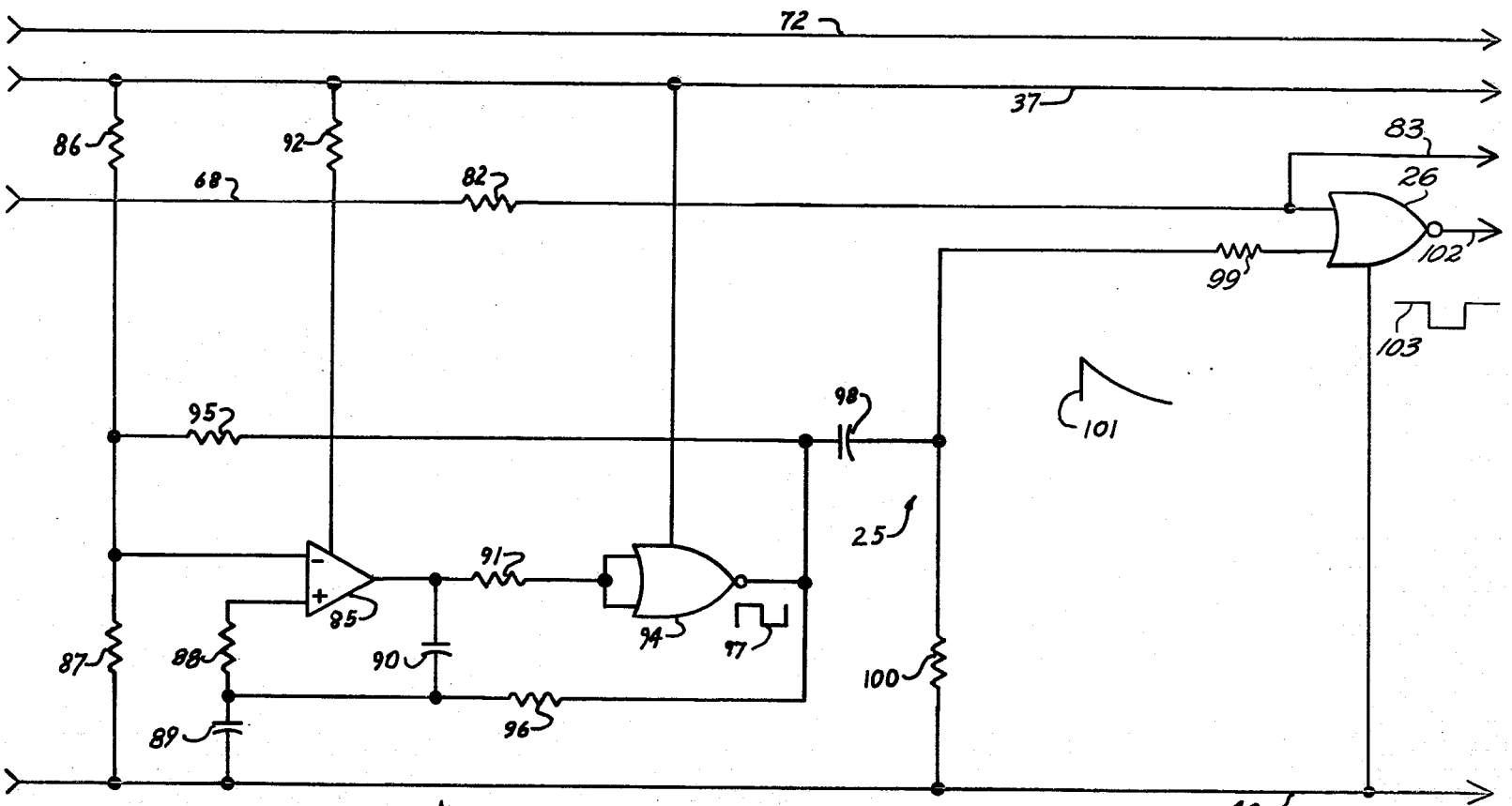
FIG. 4 is an electrical schematic diagram of the oscillator and differentiating circuitry shown in the block diagram of FIG. 2.

As indicated in FIG. 4, the output from transistor 67 (coupled through lead 68) is coupled through resistor 82 to lead 83. As indicated in FIG. 5, lead 83 is connected to logic gate 22 the output of which actuates horn 12 to indicate the presence of a sensed fire at detector 18.

As also indicated in FIG. 4, oscillator 24 includes operational transconductance amplifier 85, the negative lead intput of which is connected to the junction of resistors 86 and 87 connected as a voltage divider between the +12 volt power supply and ground. The positive input to amplifier 85 is connected to resistor 88, which resistor is connected with ground through capacitor 89 and with the output side of the amplifier through capacitor 90. The output from amplifier 85 is coupled through resistor 91, with the amplifier also being connected to the +12 volt power supply through resistor 92. Resistor 91 is connected to logic gate 94 the output of which is connected back to the negative input of amplifier 85 through resistor 95 and positive input through resistors 88 and 96. Oscillator 24 has a 30-second oscillation period as indicated by waveform 97 that is coupled to differentiating circuit 25.

As indicated in FIG. 4, differentiating circuit 25 includes capacitor 98 and resistors 99 and 100, with resistor 100 being connected at one side to ground lead 40. The output from the differentiating circuit (see waveform 101) is coupled from resistor 99 to logic gate 26 (shown as a NOR gate). NOR gate 26 receives an input from lead 68 through resistor 82, and the output from the NOR gate is coupled on lead 102 (see waveform 103) to the base of transistor 105 (shown in FIG. 5).

Figure 5:
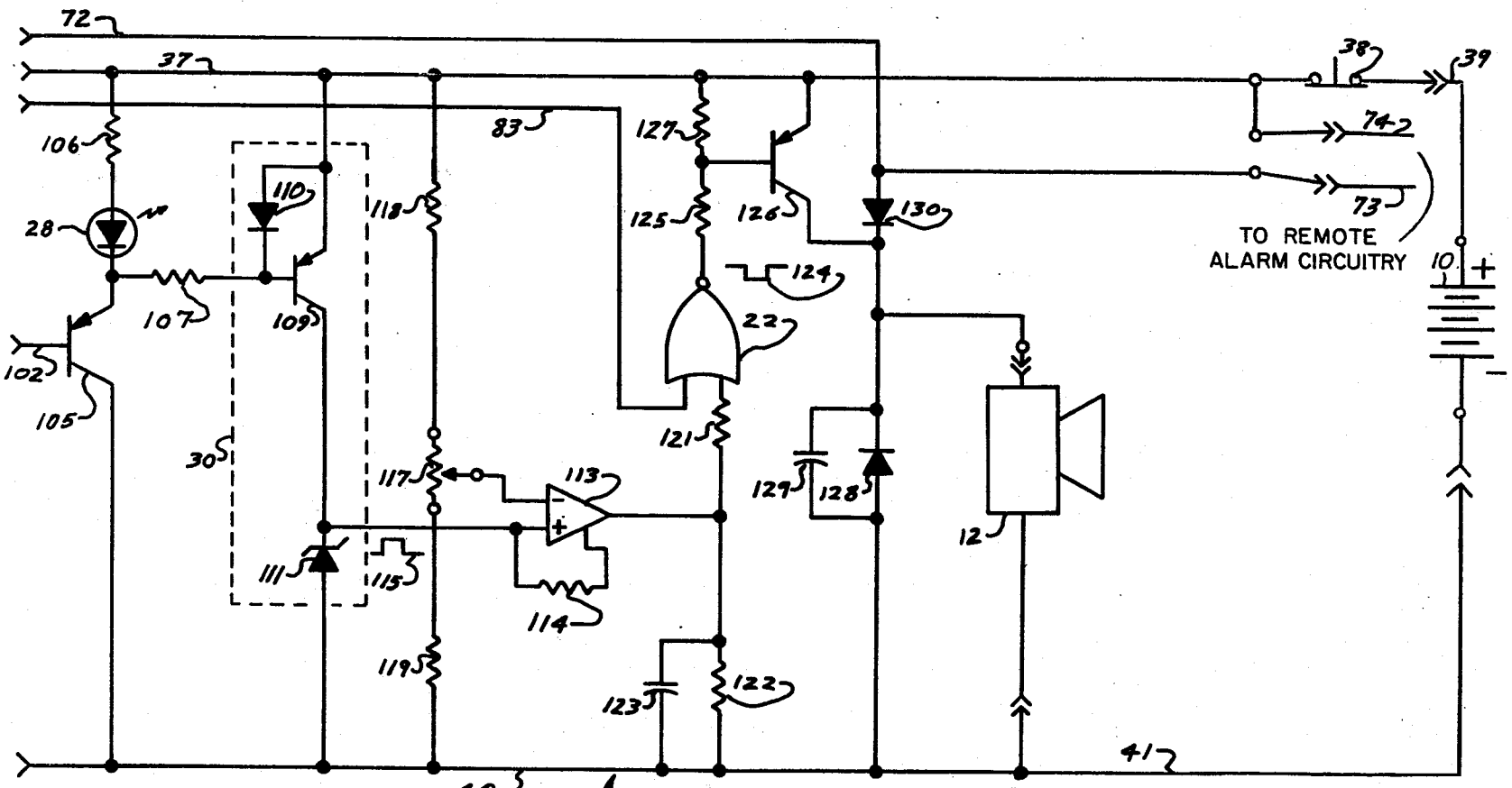
FIG. 5 is an electrical schematic diagram of the indicators and battery voltage monitor circuitry shown in the block diagram form of FIG. 2.

As indicated in FIG. 5, the emitter of transistor 105 is connected to one side of light 28 (indicated as a light emitting diode) and the other side of the light is connected with the +12 volt power supply through resistor 106. The emitter of transistor 105 is also connected through resistor 107 to voltage reference 30. As indicated in FIG. 5, voltage reference circuitry 30 includes transistor 109, diode 110 and Zener diode 111 (all of which are included in a CA 3060 AD array). As shown, diode 110 is connected between the base and emitter of transistor 109, while the collector is connected to one side of the Zener diode, the other side of which is connected to ground lead 40.

The output from the voltage reference is taken from the collector and coupled to the positive input of operational transconductance amplifier 113, which is a part of battery threshold detector 32. A resistor 114 is also connected between the positive input of amplifier 113 and input pin 10 thereof. The input to the amplifier 113 is shown by waveform 115 (which varies between about 5 and 9 volts).

Amplifier 113 has its negative input connected to the movable contactor of potentiometer 117, which potentiometer is connected as a part of a voltage divider which includes resistors 118 and 119 connected between the +12 volt power supply and ground. The movable contactor of potentiometer 117 is adjusted so that the amplifier will provide an output only when the battery voltage drops below a predetermined minimum value. When this occurs, an output is provided from amplifier 113 and the output is coupled through resistor 121 to logic gate 22. As also indicated in FIG. 5, the output of amplifier 113 is connected with ground lead 40 through parallel connected resistor 122 and capacitor 123.

As also shown, logic gate 22 receives an output on lead 83 and provides an output to actuate horn 12. The output from NOR gate 22 is shown by waveform 124 and this output is coupled through resistor 125 to transistor 126, which transistor has its base connected to the +12 volt power supply through resistor 127. The collector of transistor 126 is connected to horn 12, which horn has diode 128 and capacitor 129 connected in parallel therewith. In addition, a diode 130 is connected between lead 72 and the collector of transistor 126.

In operation, the battery threshold detector, which includes transconductance amplifier 113, is normally in an off condition until such time as the battery voltage falls below a predetermined minimum value (preferably selected at 10½ volts). If the voltage does fall below the minimum value, then an output is provided to sound the horn every 30 seconds under the control of oscillator 24.

In operation, the unit is initially set up so that there is no alarm indication so long as smoke sensed at detector 18 is below a predetermined minimum value (which value can be, for example, on the order of about one percent per foot obscuration). If desired, the unit can be initially adjusted with equipment such as disclosed in my U.S. Pat. application, Ser. No. 537,300, filed Dec. 30, 1974 and entitled "Combustion Product Indicator." When the unit is initially adjusted with such equipment, a nominal setting of 3.5 has been found to be preferred.

After the unit is adjusted, no audible output is provided by horn 12 until such time as smoke indicative of presence of a fire is sensed (unless a low voltage is sensed). In the meantime, the output from oscillator 24 will energize light 28 to blink the same periodically since the light will be energized for a short period of time once every 30 seconds due to the action of oscillator 24 and differentiating circuit 25. Upon receipt of an indication of a fire sensed by detector 18, horn 12 will be activated and light 28 will remain on constantly since an output will be received from fire detector 18 through latch circuitry 20, line 68 and resistor 82.

The system will automatically monitor the battery voltage and so long as the battery voltage remains above the predetermined minimum value (10½ volts), amplifier 113 remains de-energized and no output is coupled through NOR gate 22 to sound the horn. When a low voltage is sensed, however, this being an indication that the batteries need replacement, which indication is a voltage below 10½ volts as sensed under load, then the battery threshold detector will cause amplifier 113 to produce an output, which output will be coupled to horn 12 through transistor 126. This will cause the horn to sound for a short period of time once every 30 seconds since the horn will be controlled by oscillator 24 and differentiating circuit 25. Thus, the periodic beeping, or energization, of horn 12 will indicate a low voltage condition and/or the need for battery replacement and thus makes the unit reliable.

Thus, in summary, after the batteries have been inserted and the unit has been initially adjusted for normal use, the unit can be placed in any convenient location, such as on the wall of a home or the like, and will thereafter provide automatic monitoring for fire. The unit need only be periodically checked to assure operability by the blinking of the light. As a further check, smoke can be periodically caused to be sensed by indicator 18 to cause the horn to sound. When this occurs, the unit can be reset by depressing switch 38 which will terminate the horn sound, and the unit will then be ready for further fire monitoring. If the smoke has not cleared from the detector prior to reset by switch 38, the horn will again sound. Thus it has been found preferable to clear the smoke from the environment of the detector and then depress switch 38 to place the unit in condition for further use.

The following is a list of components that have been utilized in a working embodiment of this invention. It is to be realized, however, that this invention is not meant to be limited to the particular components listed, but rather that the components are meant only for purposes of illustration. The components are as follows Resistors (ohms)—36-1.5k; 47-1M; 50 (pot) - 0 to 1M; 51-300K; 52-1M; 53-10M; 55-1M; 56-1M; 60-1M; 61-300k; 62-1.5k; 63-22k; 66-22k; 71-1.5k; 82-1M; 86-1M; 87-1M; 88-1M; 91-1M; 92-10M; 95-1M; 96-22M; 99-1M; 100-2.7M; 106-1.5k; 107-22k; 114-1M; 117 (pot) - 0 to 1M; 118-300k; 119-1M; 121-1M; 122-10M; 125-1k; and 127-10k.

Capacitors ( Fd)—42-0.1; 43-0.1; 58-0.1; 64-0.01; 89-1; 90-0.01; 98-0.01; 123-0.001; and 129-0.1.

FET 45 -2N4117A.

Transistors —67-2N3906; 70-2N3904; 105-2N3906; and 126-2N2905.

Diodes .—76-1N4148; 128-1N4004; and 130-1N4004.

From the foregoing, it can be seen that this invention provides a compact battery operated fire detection unit that can be utilized to automatically detect the presence of fire and which is capable of providing monitoring for long periods of time.

What is claimed is:

1. A fire detection unit, comprising: battery means; ionization detection means connected with said battery means and producing an output indicative of sensed smoke; threshold detection means for receiving the output from said ionization detection means and producing an output when said output from said ionization detection means exceeds a predetermined value; oscillator means; logic gate means connected to receive the output from said oscillator means and the output from said threshold detection means; light means connected to said logic gate means whereby said light means is caused to be periodically energized to indicate proper operation of said unit and continuously energized when an output is produced by said threshold detection means; and alarm means connected to said threshold detection means and connected with said battery means, said alarm means being operable independent of said oscillator means so as to be responsive to an output from said threshold detection means to provide a continuous alarm indication.

2. The fire detection unit of claim 1 wherein said unit includes latch means connected between said threshold detection means and said alarm means and between said threshold detection means and said logic gate means.

3. The fire detection unit of claim 1 wherein said unit includes differentiating means connecting said oscillator means and said logic gate means.

4. The fire detection unit of claim 1 wherein said alarm means is a horn sounding an audible output.

5. The fire detection unit of claim 1 wherein said unit includes battery threshold detection means connected with said battery means and with said alarm means to indicate when said battery means needs replacement.

6. A fire detection unit, comprising: ionization detection means producing an output indicative of sensed smoke; threshold detection means for receiving the output from said ionization detection means and producing an output when said output from said ionization detection means exceeds a predetermined value; latch means connected to said threshold detection means to receive the output therefrom and providing an output reflective thereof; oscillator means the output of which is connected to differentiating means; logic gate means receiving the output from said differentiating means and from said latch means; light means receiving the output from said logic gate means to provide both an indication of proper operation of said unit and an indication of a sensed alarm condition; and alarm means connected with said latch means and operable independent of said oscillator means with said alarm means being responsive to an output from said latch means to provide a continuous alarm indication.

7. The fire detection unit of claim 6 wherein said unit also includes a low voltage threshold detector means connected to said alarm means and a voltage reference circuit connected to receive the output from said latch means, said voltage reference circuit being connected to said low voltage threshold detector means so that said low voltage threshold detector means provides an indication of possible faulty operation of said detection unit to said alarm means.

8. A fire detection unit, comprising: ionization detection means for providing an output indicative of sensed smoke; signal processing means for receiving the output from said ionization detection means and providing an output indicative of detected smoke; oscillator means; logic gate means receiving the output from said oscillator means and said signal processing means; visual indicating means connected with said logic gate means and providing a first output indicative of proper operation of said unit and a second output indicative of an alarm indication; and alarm means independently operable with respect to said oscillator means and connected with said signal processing means so as to be responsive to an output from said signal processing means and thereby providing an alarm indication.

9. The fire detection unit of claim 8 wherein said unit includes a differentiating circuit connected between said oscillator means and said logic gate means.

10. The fire detection unit of claim 8 wherein said unit includes low voltage threshold detection means connected to receive the output from said logic gate means and monitoring said voltage coupled to said unit, said low voltage detection means providing an output to said alarm means to indicate possible faulty operation of said unit due to reduced voltage input to said unit.

11. A fire detection unit, comprising: battery means; ionization detection means connected with said battery means and providing an output indicative of sensed smoke; threshold detection means for receiving the output from said ionization detection means and providing an output when said output from said ionization detection means exceeds a predetermined value; latch means connected to receive the output from said threshold detection means and providing an output indicative thereof; first logic gate means connected to receive the output from said latch means; alarm means connected to receive the output from said first logic gate means and responsive to an output from said ionization detection means providing an alarm indication; oscillator means; a differentiating circuit connected to receive the output from said oscillating means; a second logic gate means connected to receive the output from said differentiating circuit and the output from said latch means; visual indicating means connected to receive the output from said second logic gate means, said visual indicating means when in a first condition indicating proper operation of said system and when in a second condition indicating an alarm condition; a voltage reference source connected to receive the output from said second logic gate means; and a battery threshold detector connected to receive the output from said voltage reference means and output from said battery means, said battery threshold detector providing an output to said first logic gate means when the voltage of said battery means falls below a predetermined value to thereby indicate the need for replacement of said battery means.

* * * * *